US005335051A

United States Patent [19]

Tani

[11] Patent Number: 5,335,051

[45] Date of Patent: Aug. 2, 1994

[54] FOREIGN MATERIAL REMOVING DEVICE AND DEVELOPING APPARATUS COMPRISING THE SAME

[75] Inventor: Tatsuo Tani, Urayasu, Japan

[73] Assignee: Ricoh Company, Ltd., Tokyo, Japan

[21] Appl. No.: 942,047

[22] Filed: Sep. 8, 1992

[30] Foreign Application Priority Data

Sep. 8, 1991 [JP] Japan ..... 3-257101
May 27, 1992 [JP] Japan ..... 4-160329

[51] Int. Cl.[5] ..... G03G 15/08; G03G 21/00
[52] U.S. Cl. ..... 355/245; 209/222
[58] Field of Search ..... 355/245, 298, 251, 253; 209/39, 40, 222, 225-228; 118/652

[56] References Cited

U.S. PATENT DOCUMENTS 4,267,245 5/1981 Wada ..... 355/251 X
4,376,578 3/1983 Tanaka et al. ..... 355/253
4,389,968 6/1983 Satomura ..... 118/652
4,500,194 2/1985 Knott ..... 355/245

FOREIGN PATENT DOCUMENTS 57-2075 1/1982 Japan ..... 355/298
61-235876 10/1986 Japan ..... 355/245

OTHER PUBLICATIONS

*Research Disclosure,* Dec. 1977, Probst, S., "Apparatus for transporting powdered materials", No. 16448, pp. 57-58.

*Primary Examiner*—Joan H. Pendegrass
*Attorney, Agent, or Firm*—Oblon, Spivak, McClelland, Maier & Neustadt

[57] ABSTRACT

A foreign material removing device for removing foreign materials from a developer for use in electrophotography and a development apparatus including such a foreign material removing device removes foreign materials from the developer employed in the development apparatus by conveying developer to and from a separator, the separator having a rotating disk of magnets for conveying and separating by conveying the developer and allowing the foreign material to fall into a container.

11 Claims, 5 Drawing Sheets

FOREIGN MATERIAL REMOVING DEVICE AND DEVELOPING APPARATUS COMPRISING THE SAME

BACKGROUND OF THE INVENTION

1. Field of the Invention

This invention relates to a foreign material removing device for eliminating materials which do not contribute to the development of latent images in image forming apparatus such as copying machines, facsimile machines and printers. This invention also relates to a development apparatus comprising such a foreign material removing device.

2. Discussion of Background

In the above-mentioned conventional image formation apparatus, a residual toner remaining on a latent image bearing member such as a photoconductor for use in electrophotography, after toner image transfer to a recording paper, is removed by a cleaning unit. Generally the amount of such a residual toner corresponds to 5 to 30% of the total toner deposited on such a latent image bearing member.

It has been proposed to reuse the removed toner by transporting the toner back to a development apparatus, as described in Japanese Utility Laid-Open Patent Application 52-155044. The toner which was removed by the cleaning unit, however, contains paper dust, aggregated toner particles, and low-electric charged toner particles (hereinafter referred to as foreign materials). Such a foreign-materials-containing toner tends to be deposited on the background of images during the development process, causing the so-called toner deposition on the background. For this reason, recently such recovered toner is not generally used again.

On the other hand, a demand for using such recovered toner is in fact recently increasing from the view point of effective utilization of resources.

Under such circumstances, it is considered to be an effective method to remove the above-mentioned foreign materials from the toner recovered by the cleaning unit before it is transported back to the development apparatus. In this method, however, the polarity of such recovered toner to be transported back to the development apparatus is so unstable that a method of removing materials which are not sufficiently charged to a predetermined polarity from the normal toner as being foreign materials cannot be adopted in practice.

As a countermeasure to this problem, in particular in a development apparatus using a two-component developer consisting of a toner and a carrier, there can be considered a method of mixing the recovered toner with part of the two-component developer to be transported to the development apparatus before the recovered toner is transported to the development apparatus, thereby sufficiently charging the recovered toner to the desired polarity, and removing only the foreign materials from the sufficiently charged toner by use of electrostatic force.

This method, however, has the shortcomings that a large-scale unit is necessary for transporting the developer from the development apparatus and mixing the developer and the recovered toner, making the development apparatus large in size and costly. Furthermore, this method has the risk that the recovered toner cannot be necessarily sufficiently charged to the desired polarity by mere mixing the toner with the developer under transporation to the development apparatus, so that the foreign materials cannot be satisfactorily removed from the toner, and if the charging of the recovered toner is insufficient, the insufficiently charged toner may also be removed as being foreign material and high utilization of the recovered toner cannot be attained.

In addition to the above method, there has been proposed a method of transporting a toner recovered by a cleaning unit to a development apparatus and charging the toner to the desired polarity within the development apparatus to reuse the toner.

For example, Japanese Laid-Open Patent Application 59-232561 discloses the following method: A developer supplied to a development sleeve in a development unit. In the development unit, there is disposed a bucket roller portion with an built-in developer-stirring mechanism provided in the axial direction of the bucket roller portion for stirring the developer in the development unit. Furthermore, inside the developer-stirring mechanism, there are provided a low-charged toner separation mechanism, and a low-charged toner circulation portion through which only a toner which has been triboelectrically charged to a predetermined charge quantity is returned to the development unit to reuse the toner.

In the above development apparatus, the developer-stirring mechanism is provided within the bucket roller, and the low-charged toner separation mechanism, and the low-charged toner circulation portion are provided within the developer-stirring mechanism. Thus this apparatus is very complicated in the structure and therefore costly. Furthermore, the charging of the toner is not sufficiently carried out even by relatively strong triboelectric charging of the toner with the carrier on a doctor portion on a development sleeve. Despite this fact, there is no triboelectric charging mechanism capable of strongly triboelectrically charging the toner contained in the low-charged toner circulation portion. Therefore, there is the risk that the toner cannot be sufficiently charged even by the toner circulation in the low-charged toner circulation portion for an extended period of time. Moreover, since foreign materials such as paper dust and aggregated toner particles merely accumulate within the low-charged toner circulation portion, it is extremely difficult to eliminate such foreign materials from the development apparatus.

Japanese Laid-Open Patent Application 57-104956 describes that in order to prevent the toner deposition on the background of images which may be caused by a low-charged toner within a development apparatus, a member made of a material whose triboelectric series is the same as that of a photoconductor is disposed in a position before a development zone in such a manner as to be in contact with a developer held on a development roller, and a low-charged toner is triboelectrically charged by this member and caused to deposit the toner on the member, whereby the low-charged toner is removed from the developer held on the development roller.

The above-mentioned mechanism, however, cannot eliminate the foreign materials such as paper dust and aggregated toner from the developer and there is the risk that such foreign materials are bonded to the toner or adhere to the surface of the carrier during an extended image formation process, so that the charging performance of the toner is caused to deteriorate and the toner deposition on the background of images takes place.

Japanese Laid-Open Patent Application 60-256169 describes a foreign material removing device for removing foreign materials from a developer, comprising first magnetic field generating means for magnetically holding a developer and for generating an alternate magnetic field by which the developer can be sufficiently agitated, and second magnetic field generating means disposed in close vicinity with the first magnetic field generating means, in which the lines of magnetic force held by the first and second magnetic field generating means are caused to continuously cross in a space near the two magnetic field generating means, so that the developer present in the space is caused to fly successively in such a manner as to depend upon the magnetic force, and only the foreign materials contained in the developer, which are not caused to fly, are separated and eliminated therefrom.

In the above foreign material removing device, however, there is the risk that if the above-mentioned space is too large, not only the foreign materials but also part of the developer is separated and eliminated from the developer, while when the space is too small, the foreign materials cannot be sufficiently eliminated.

The Japanese Laid-Open Patent Application 60-256169 further describes that the developer may be introduced from the development apparatus into this foreign material eliminating device. However, there is the risk that unless the position for a developer inlet of a developer transportation means for transporting the developer from the development apparatus to the foreign material eliminating device is appropriately set, a developer which contains an insufficiently triboelectrically charged toner is also transported into the foreign material removing device to eliminate the toner, which may be used as proper toner if properly charged, as being a foreign material. Thus, the recovered toner cannot be used effectively.

SUMMARY OF THE INVENTION

It is therefore a first object of the present invention to provide a development apparatus with a simple structure and capable of removing foreign materials from the developer employed in the development apparatus.

A second object of the present invention is to provide a foreign material removing device for removing foreign materials from a developer.

The first object of the present invention can be achieved by a first development apparatus comprising (a) a development unit provided with (i) a developer holding portion for holding therein a developer comprising a magnetic carrier and a toner, (ii) a developer bearing member for transporting the developer from the developer holding portion into a facing gap portion between the surface of a latent image bearing member and the surface of the developer bearing member, causing the developer to pass through the facing gap portion, and recovering the developer which has passed through the facing gap portion, and (iii) electric charge application means for applying electric charges to the toner contained in the developer which is to be carried by the developer bearing member to the facing gap portion, and (b) a toner holding unit for holding therein the toner to be supplied to the developer holding portion, the developer being transported onto the charge application means, thereby electrically charging the toner in the developer, and the developer being returned to the developer holding portion after the developer is transported to the latent image bearing member and a latent image formed on the latent image bearing member is developed with the toner to a visible toner image, in which there are provided first developer transport means for transporting the developer to the outside of the development unit; second developer transport means for transporting the developer into the development unit from the outside thereof; third developer transport means for receiving the developer from the first developer transport means and transporting the developer to the second developer transport means by use of magnetic force; and foreign material recovering means for recovering foreign materials which cannot be transported by the magnetic force of the third developer transport means, a developer inlet for taking in the developer of the first developer transport means being situated, in a circulation path for the developer, at a position between the charge application means and the facing gap portion, or at a position between the facing gap portion and the developer holding portion.

The first object of the present invention can also be achieved by a second development apparatus for developing a latent image formed on a latent image bearing member with a magnetic developer, comprising: first developer transport means for transporting the developer to the outside of a development unit; second developer transport means for transporting the developer into the development unit from the outside thereof; third developer transport means comprising a developer guide wall, developer suction means for sucking the developer by magnetic force through the developer guide wall, and means for moving the developer suction means, and capable of receiving the developer from the first developer transport means and transporting the developer to the second developer transport means; and foreign material recovering means for recovering foreign materials contained in the developer, which cannot be transported by the third developer transport means.

The first object of the present invention can also be achieved by a third development apparatus for developing latent images formed on a latent image bearing member with a magnetic developer, comprising: first developer transport means for transporting, in a first direction, at least part of the developer to be circulated in a developer circulation path in a development unit; second developer transport means for transporting the developer in a direction which is parallel with the first direction, and opposite to the first direction; and foreign material removing means for removing from the developer foreign materials which do not contribute to the development of latent images, the foreign material removing means being situated outside a development unit in the first direction; at least one of the first developer transport means or the second developer transport means being connected with the foreign material removing means.

Furthermore the first object of the present invention can be achieved by a fourth development apparatus for developing latent images formed on a latent image bearing member with a magnetic developer, comprising: a developer guide member including an opening at a lower portion thereof, with concave and convex portions being formed at least part of the inner peripheral surface thereof; magnetic field generating means for generating a magnetic field with the magnetic poles thereof being movable along the concave and convex portions of the developer guide member; and a receiving member disposed below the opening.

The second object of the present invention can be achieved by a foreign material removing device for removing foreign materials from a developer comprising: a developer guide member which is hollow, constitutes a substantially U-shaped developer transport path, disposed outside a development unit, and includes an opening in part of a lower guide wall thereof; magnetic field generating means for generating a magnetic field with the poles thereof being successively rotatable along the developer transport path; a receiving member disposed below the opening; developer transport means for transporting the developer in the member; and developer transport means for transporting the developer from the other end portion of the developer guide member to the development unit.

BRIEF DESCRIPTION OF THE DRAWINGS

A more complete appreciation of the invention and many of the attendant advantageous thereof will be readily obtained as the same become better understood by reference to the following detailed description when considered in connection with the accompanying drawings, wherein:

FIG. 1(*b*) is a schematic cross-sectional view of an foreign material removing device of the present invention which is connected to the above-mentioned development unit;

DETAILED EXPLANATION OF THE PREFERRED EMBODIMENT

The present invention will now be explained with reference to an example of an electrophotographic copying apparatus to which the present invention is applied.

Figure 2:
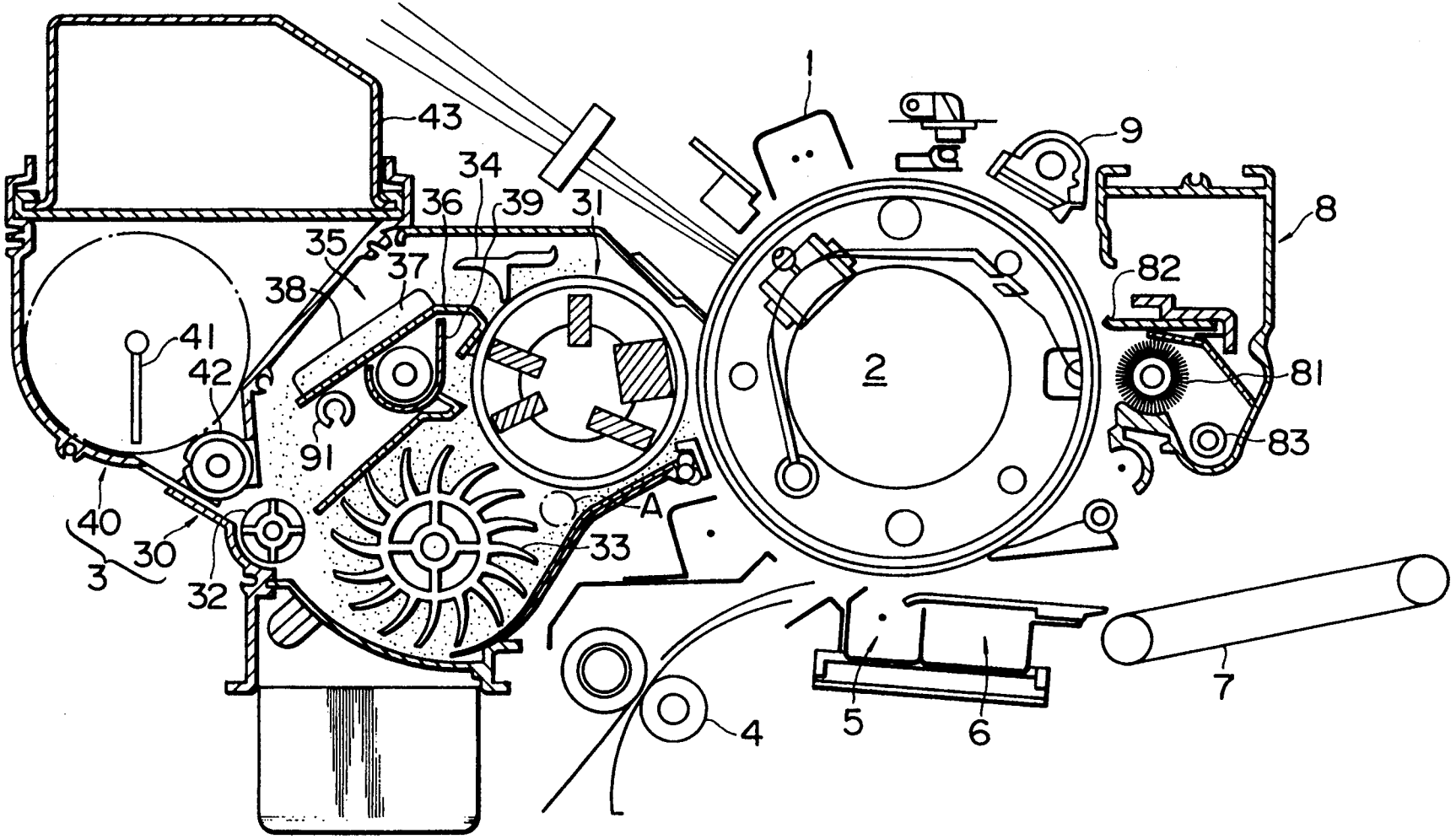
FIG. 2 is an cross-sectional view of an electrophotographic copying apparatus in which the development unit for use in the present invention is employed.

FIG. 2 schematically shows such an example of an electrophotographic copying apparatus.

In the figure, the image of an original placed on a contact glass (not shown) is projected to a latent electrostatic image bearing member, that is, a drum-shaped photoconductor 2 (hereinafter referred to as the photoconductor drum 2) which has been uniformly charged by a charger 1, by an optical system (not shown) including illuminating means to illuminate the original, which is moved in parallel with the contact glass, so that a latent electrostatic image is formed on the photoconductor drum 2.

The thus formed latent electrostatic image is developed a visible toner image by a toner placed in a development apparatus 3 disposed on the left side of the photoconductor drum 2.

The toner image is then transferred by an image transfer charger 5 onto a transfer paper which is timely transported by a resist roller 4 from a paper supply portion (not shown ) of the copying apparatus.

The toner-image-bearing transfer paper is separated from the photoconductor drum 2 by a separation charger 6 and transported to an image fixing apparatus (not shown) by a transportation belt 7. The toner image on the transfer paper is fixed thereto in the image fixing apparatus, and then the image-bearing transfer paper is carried out of the copying apparatus.

After the image transfer, the residual toner remaining on the surface of the photoconductor drum 2 is removed therefrom by a cleaning unit 8, which is disposed on the right side of the photoconductor drum 2.

The residual electric charges on the surface of the photoconductor drum 2 are quenched by a quenching lamp 9, and the surface of the photoconductor drum 2 is then uniformly charged by the charger 1 for the next latent electrostatic image formation.

The cleaning unit 8 is provided with a fur brush roller 81 for removing the residual toner from the surface of the photoconductor drum 2, a cleaning blade 82, and an auger 83 for discharging recovered toner to the outside of the cleaning unit 8.

The development apparatus 3 will now be explained in detail with reference to FIG. 2. The development apparatus 3 comprises a development unit 30 which is disposed directed toward the photoconductor drum 2, a toner supply unit 40 disposed on the right above of the development unit 30.

The toner supply unit 40 serves to supply a toner to the development unit 30 and comprises a toner hopper with an inner built toner stirrer bar 41, and a toner supply roller 42 at the bottom portion thereof for supplying the toner to the development unit 30. On the upper portion of the toner supply unit 40, there is provided a detachable toner cartridge 43 for supplying the toner to the toner hopper portion. The toner cartridge 43 serves as a lid for the toner hopper portion.

The development unit 30 holds a developer consisting of the toner and a carrier and includes an opening directed toward the surface of the photoconductor drum 2, and a development sleeve 31 with a built-in magnet, by which the developer is transported onto the surface of the photoconductor drum 2.

Furthermore, in the development unit 30, there are provided a mixing roller 32 which mixes the toner supplied into the development unit 30 by the toner supply roller 42 and the developer already present in the development unit 30, a mixing paddle 33 for mixing the developer supplied from the mixing roller 32 and the developer detached from the surface of the development sleeve 31 after having passed through a facing gap portion between the development sleeve 31 and the photoconductor drum 2, a doctor 34 for regulating the amount of the developer held on the surface of the development sleeve 31, which is to be transported to the surface of the photoconductor drum 2, and a transverse mixing device 35 for returning the developer scraped by the doctor 34 to the mixing paddle 33 and for mixing the developer in the axial direction of the photoconductor drum 2.

The transverse mixing device 35 mixes the developer whose toner is non-uniformly consumed in the axial direction of the development sleeve 31 in order to make the toner concentration of the developer uniform in the axial direction of the development sleeve 31 and to maintain the uniform toner concentration.

The transverse mixing device 35 comprises a developer guide member 36 provided with a predoctor portion which is disposed close to the development sleeve 31 and regulates the amount of the developer on the development sleeve 31 before the doctor 34, and an inclined plate portion for causing the developer scraped by the doctor 34 to flow therealong; and a transverse mixing auger 37 for transporting the developer which flows down from a developer flow outlet formed in the inclined plate portion at the inner part of the transverse mixing device 35 to the front side of the transverse mixing device 35. The inclined plate portion of the developer guide member 36 is provided with a number of inclined fins 38 for causing the developer to flow down while guiding the developer to the inner side of the device. A conduit member 39 is provided along the transverse auger 37.

During the development operation, the development sleeve 31, the mixing roller 32, the mixing paddle 33, and the transverse mixing auger 37 are driven in rotation in the respectively predetermined directions, so that the developer is transported successively along the mixing roller 32, the mixing paddle 33, the development sleeve 31 and the doctor 34, so that the developer is separated into a developer which is held onto the development sleeve 31 and transported onto the surface of the photoconductor drum 2, and a developer which is caused to flow down along the inclined plate portion of the developer guide member 36 and returned to the mixing roller 32.

The developer carried by the development sleeve 31 and transported onto the surface of the photoconductor drum 2 is used for development of a latent electrostatic image formed on the photoductor drum 2 in a facing gap portion between the development sleeve 31 and the photoconductor drum 2, returned to the development unit 30 and caused to fall onto the mixing paddle 33. The developer is then returned to the mixing roller 32, mixed by the mixing roller 32, and again supplied onto the development sleeve 31.

The developer which drops from the developer outlet formed in the inclined plate portion of the developer guide member 36 during this circulation of the developer is transported to the front side of the development apparatus by the transverse mixing auger 37. The developer which falls down along the inclined plate portion of the developer guide member 36 is transported to the inner side of the development apparatus by the inclined fins 38. The stirring of the developer in the transverse direction is carried out by the well balanced transfers of the developer in the opposite directions with respect to the axial direction of the development sleeve 31. The toner supplied from the toner supply unit 40 is mixed with the developer near the mixing roller 32.

Figure 3:
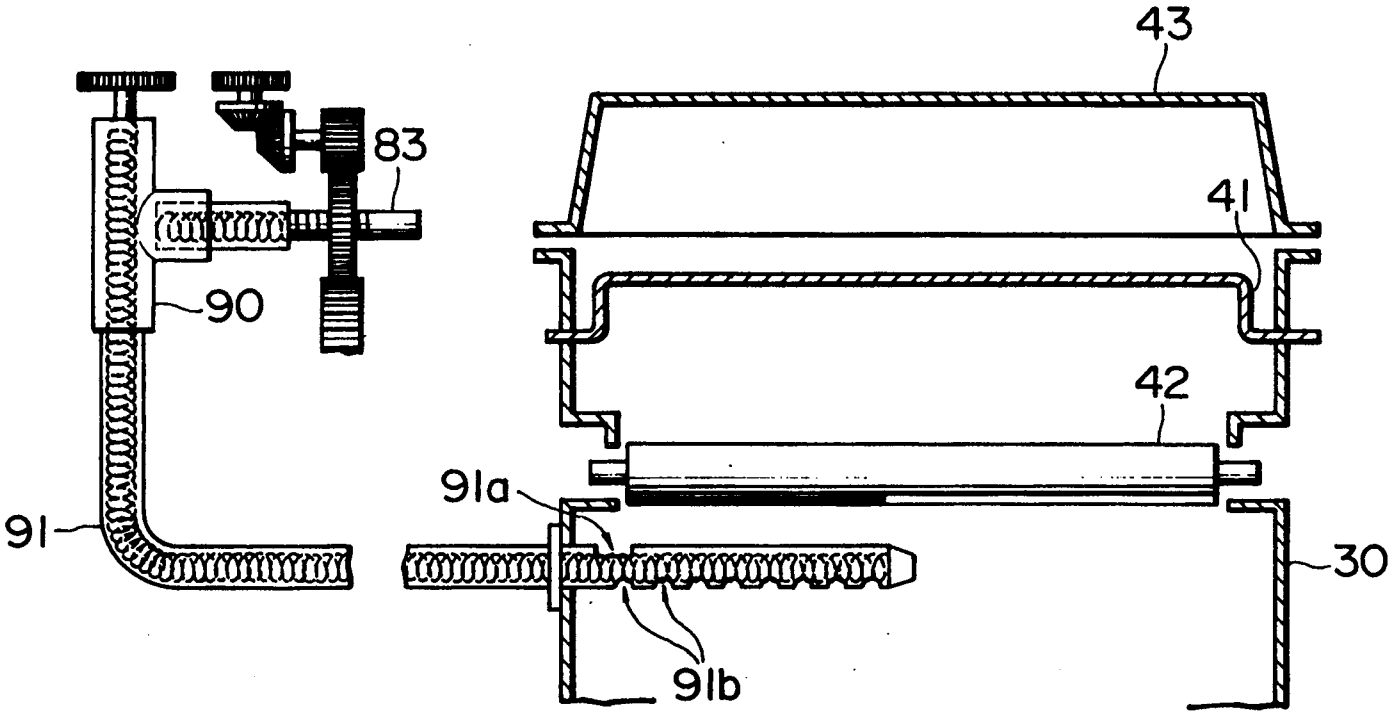
FIG. 3 is a schematic diagram for explaining a toner transport path from a cleaning unit of the electrophotographic copying apparatus to the development unit thereof.

In this example, the toner discharged by an auger 83 for discharging the toner recovered by the cleaning unit 8 is transported into the development unit 30 to reuse the toner by a toner transport pipe 91 with an inner built-in toner transport coil 90 as shown in FIG. 3. For this purpose, a developer inlet hole **91*a* is formed in the upper portion of a portion of the toner transfer pipe 91 which extends into the development unit 30, and toner discharging holes 91*b* are formed in the lower portion of the toner transfer pipe 91 which extends into the development unit 30**.

The toner immediately after discharged from these toner discharging holes **91*b* may contain toner particles with reduced charge quantities. However, the toner is then scooped up by the mixing paddle 33 and transported onto the development sleeve 31, and then intensely triboelectrically charged with the carrier by electric charge application means such as the predoctor portion of the developer guide member 36 and the doctor 34. Thus, the toner is sufficiently charged to the desired predetermined polarity during this circulation of the developer and used for development of latent electrostatic images formed on the surface of the photoconductor drum 2**.

Figure 4:
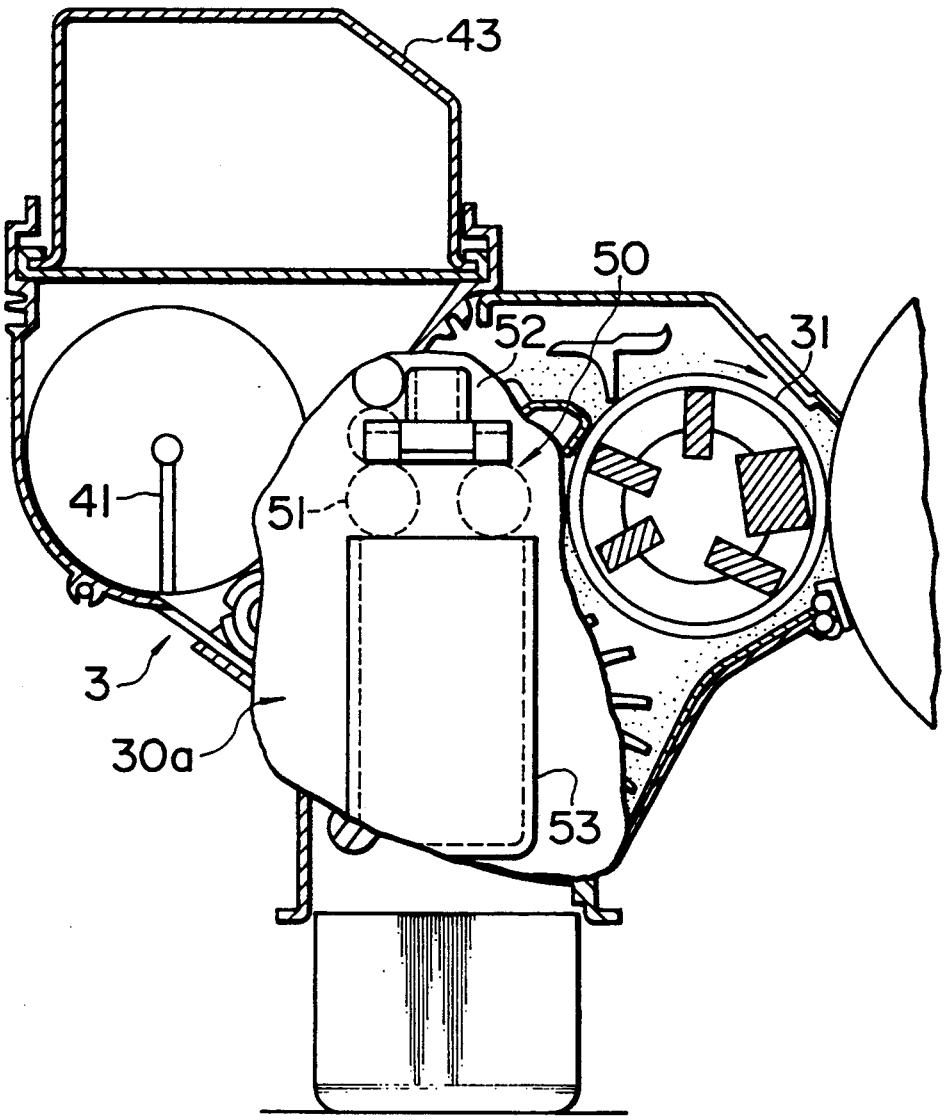
FIG. 4 is a schematic partially cutaway cross-sectional view showing the attachment of the foreign material removing device of the present invention to the development unit in the electrophotographic copying apparatus.

Furthermore, in this example, a foreign material removing device 50 for removing foreign materials such as a low-charged toner and paper dust from the developer is provided on a front side wall **30*a* of the development unit 30 as shown in FIG. 4**.

The foreign material removing device 50 in this example according to the present invention will now be explained. The foreign material removing device 50 comprises a developer transport portion 51 for transporting the developer, a magnetic field generating portion 52 which is disposed above the developer transport portion 51, and a foreign material recovering container 53.

Figure 1A:
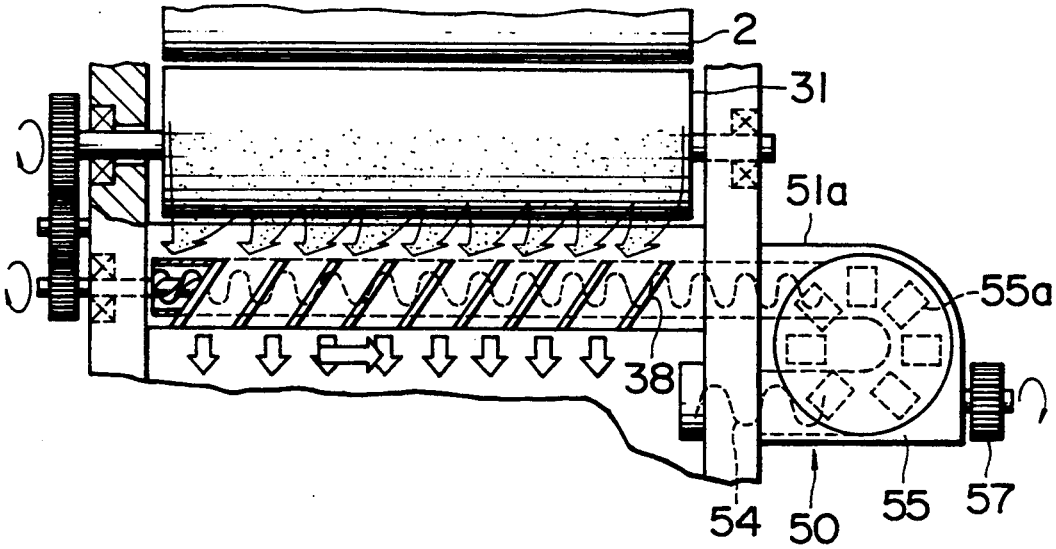
FIG. 1(*a*) is a top view of part of a development unit for use in the present invention.
Figure 1B:
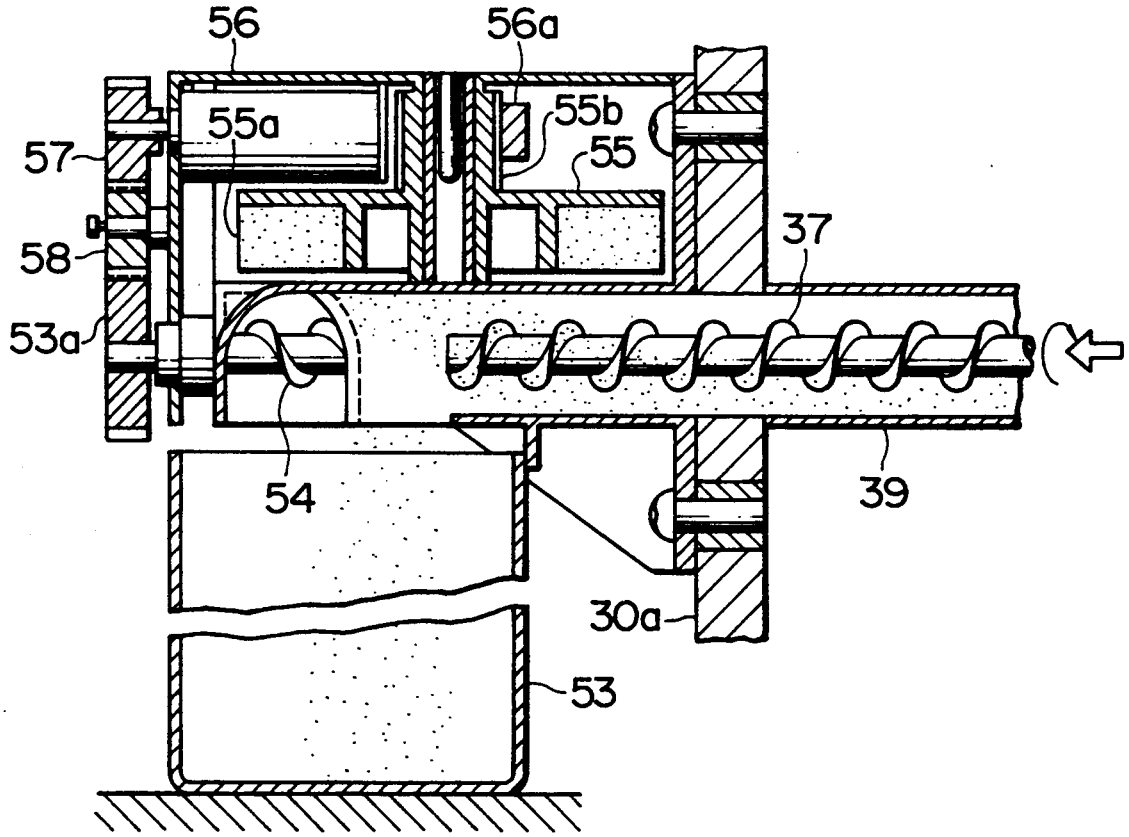
Figure 5:
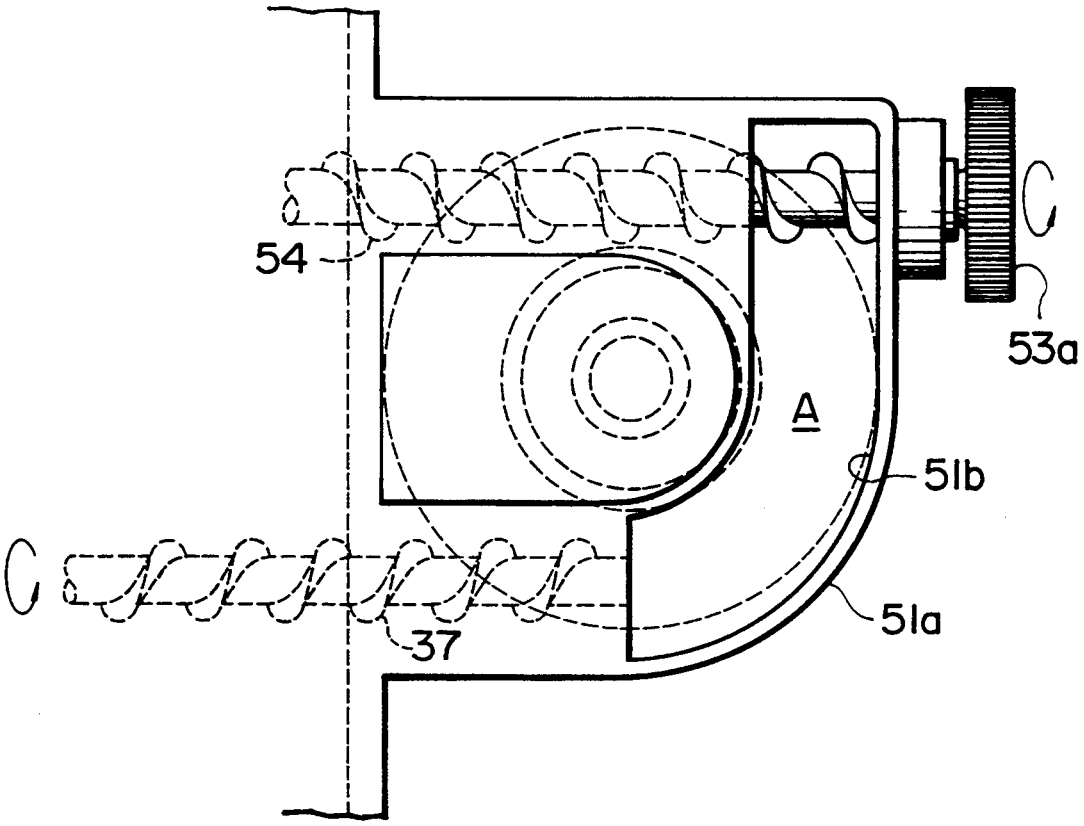
FIG. 5 is a bottom view of the foreign material removing device according to the present invention.
Figure 6:
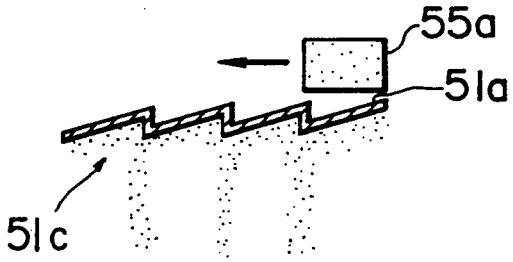
FIG. 6 is a diagram showing an example of the structure of the inside of a developer transport pipe in the foreign material removing device of the present invention.

The developer transport portion 51 is in a substantially U-bent shape when viewed from the above on the left side of the apparatus as shown in FIG. 1(*aa*) and comprises (1) developer transport pipe **51*a* which is attached to the front wall of the development unit 30, in such a configuration that the opposite ends of the developer transport pipe 51*a* correspond to a pair of through holes formed with a predetermined interval at the same height as that of the developer transport pipe 51*a*; and (2) a return auger 54 for transporting the developer from which foreign materials have been removed back to the development unit 30. In this example, the transverse mixing auger 37 provided in the development unit 30 is also used to transport the developer from the development unit 30. For this purpose, one of the above-mentioned through holes is formed at a position corresponding to the position of the transverse mixing auger 37, and the transverse mixing auger 37 is extended up to part of a straight-line portion of the developer transport pipe 51*a* corresponding to the hole. The above-mentioned return auger 54 is provided within another straight-line portion of the developer transport pipe 51*a*. The lower wall of the bent portion of the developer transport pipe 51*a* is opened as shown in FIG. 5 and the opening portion constitutes a foreign material outlet A from which foreign materials are caused to fall. In FIG. 5, reference symbol 51*a*** indicates the edge portion of the opening.

The magnetic field generating portion 52 is composed of a magnetic wheel 55 provided with a plurality of permanent magnets **55*a* in a circular configuration at the lower surface thereof, and a drive motor 56 for rotating the magnetic wheel 55**.

The magnetic wheel 55 is formed and provided in such a shape and in such a configuration that the magnetic force of the permanent magnets **55*a* is exerted on the developer present in the bent portion of the developer transport pipe 51*a***.

In this example, an output shaft of the drive motor 56 is attached to each of both sides of the motor. A worm **56*a* attached to one of the output shafts engages a worm wheel 55*b* formed on the peripheral surface of the shaft which extends upward from the center of the magnet wheel 55, so that the magnet wheel 55 is driven. A gear 57 attached to the other output shaft engages an idle gear 58 which engages an input gear 53***a* fixed to the shaft of the return auger 54, so that the auger 54 is driven.

The foreign material removing device 50 is operated as follows:

During the development operation, the drive motor 56 drives the magnet wheel 55 and the return auger 54 in rotation. Under such conditions, part of the developer in the development unit 30 is transported up to the straight-line portion of the transfer pipe 51 *a* by the transverse mixing auger 37. Foreign materials are contained in the developer. This developer is sucked by the magnetic force or the permanent magnets 55*a* of the magnet wheel 55 and transferred to the return auger 54, while the developer is brought into contact with the upper wall of the bent portion of the transfer pipe 51*a*. When the carrier of the developer is transported above the foreign material outlet A in the bent portion while the carrier is attracted to the permanent magnets 55*a*, foreign materials such as a toner charged to an opposite polarity, a low-charged toner, paper dust, an aggregated toner are dropped into the foreign material container 53 through the foreign material outlet A, without being attracted to the carrier. The developer which has reached the return auger 54 is then transported into the development unit 30 by the return auger 54. For example, as can be seen from FIG. 5, since the attraction force of the permanent magnets is not substantially exerted onto a portion of the transport pipe 51*a*, near the side wall of the development unit 30, the developer can be smoothly transported into the development unit 30 by the return auger 54.

In this example, the developer falls from the developer flow outlet formed in the inclined plate portion of the developer guide member 36 and is transported by the transverse mixing auger 37 to the foreign material removing device 50 disposed on the front side of the apparatus. The developer is scooped onto the development sleeve 31 by the mixing paddle 33, and the toner of the developer is appropriately and sufficiently, triboelectrically charged by relatively strong friction with the carrier at the predoctor portion of the developer guide member 36. So long as this triboelectric charging is appropriate, the improper transportation of the toner to the foreign material removing device 50 and the removal thereof as being a foreign material can be avoided.

In order to transport the developer with the toner Thereof being sufficiently frictioned to the foreign material removing device 50, the developer may be transported into the foreign material removing device 50 from the portion up to a developer holding portion at the bottom of the development unit 30 after the developer has been transported into the development unit 30, passing through a development zone as shown by a circle A indicated by the alternate long and short dashes line in FIG. 2, instead of transporting the developer into the foreign material removing device 50 from the portion where the developer has passed through the predoctor portion of the developer guide member 36.

Furthermore, in order to transport the developer including the thus sufficiently frictioned toner into the development unit 30 to reuse the toner with a relatively high efficiency, the foreign material removing device as described in the previously mentioned Japanese Laid-Open Patent Application 60-256169 can be used instead of the foreign material removing device 50 employed in the above example.

In the foreign material removing device 50 employed in the above example, concave and convex portions 51*c* are provided in the inner, upper surface of the developer transport pipe 51 *a* with which the developer is brought into contact by the magnetic force of the permanent magnets, and vibrations are applied to the developer, whereby the foreign material separation effect can be improved.

Furthermore, in the above example, a plurality of permanent magnets 55*a* is attached to the lower surface of the magnet wheel 55. Instead of this, a magnetic material can be applied to the lower surface of the magnet wheel 55 and the applied magnetic material can be subjected to multi-polar magnetization to form a magnet.

Instead of rotating the magnet wheel 55 provided with the permanent magnets 55*a*, a plurality of electronmagnets is fixed and the polars thereof are successively changed or the electronmagnets are successively turned on or off to transport the developer while it is caused to fly. In this case, the flying of the developer improves the foreign material separation effect. The transfer of the developer is carried out along a curved transfer path in the above example. Instead of the curved transfer path, a straight line path can also be employed.

The magnetic force generating means may be provided on one side of the developer transfer path, not above the developer transfer path, for instance, at the outer peripheral portion or inner peripheral portion of the U-shaped transfer pipe 51*a*.

Furthermore, in the above example, the transverse mixing auger 38 is employed to transport the developer from the development unit 30 into the foreign material removing device 50. However, a developer transport means other than the transverse mixing auger 38 in the development unit 30 may be used.

The above example is directed to a development apparatus using a two-component developer. The present invention can be applied not only to a development apparatus using a magnetic one-component type developer, but also to a development apparatus for an image formation apparatus other than the electrophotographic image formation apparatus.

In the previously mentioned first development apparatus according to the present invention, the third developer transport means receives the developer from the first developer transport means and transports the developer to the second developer transport means by use of magnetic force, and the developer inlet for taking in the developer of the first developer transport means is situated, in a circulation path for the developer, at a position between the charge application means and the facing gap portion, or at a position between the facing gap portion and the developer holding portion, whereby she developer whose toner has been sufficiently charged within the development apparatus is transported into the third development transport means. Furthermore, the foreign materials which cannot be transported by the magnetic force of the third developer transport means are recovered by the foreign material recovering means. Therefore, the risk that the toner which is merely low-charged is separated as being a foreign material is much less in comparison with the case where foreign materials are removed from the toner recovered in the course from the cleaning unit to the development apparatus.

In the previously mentioned second development apparatus according to the present invention, by the third developer transport means comprising a developer guide wall, developer suction means for sucking the developer by magnetic force through the developer guide wall, and by the means for moving the developer suction means, the developer from the development apparatus, received from the first developer transport means, is transported while being sucked. At this time, foreign materials which do not adhere to the developer and cannot be transported by the third developer transport means are recovered by the foreign material recovering means, and the developer from which the foreign materials are separated is transported into the development apparatus by the second developer transport means. Therefore, the developer and the foreign materials in the development apparatus can be surely separated.

In the previously mentioned third and fourth development apparatuses and the foreign material removing device according to the present invention, the developer in the developer guide member with an opening at least part of the lower guide wall thereof is transported while sucked by the moving magnetic field generated by the magnetic field generating means, whereby the developer on which the suction force by the moving magnetic field is exerted is transported in such a manner as not to be dropped from the opening, while the foreign materials which are not attracted to the developer are dropped from the opening onto a receiving member. Thus, such foreign materials can be removed from the developer speedily by the device with such a simple structure. Furthermore, since such foreign materials can be speedily separated and removed from the developer, in a development apparatus using a two-component developer consisting of toner and a carrier, the deterioration of the carrier which may be caused by disadvantageous, extended mixing of the carrier and a low-charged toner and foreign materials such as paper dust can be completely avoided. Accordingly the reduction of the chargeability of the toner can be prevented. Moreover since the receiving member for receiving such foreign materials is disposed outside the development apparatus, such foreign materials can be discarded regardless of the changing cycle of the developer.

In the previously mentioned foreign material removing device according to the present invention, the developer transport path is substantially U-shaped, and the developer is transported by the magnetic field generating means which generates magnetic field with the magnetic poles thereof being successively rotated along the developer transport path. This provides a compact size, and inexpensive foreign material removing device.

In the previously mentioned third development apparatus according to the present invention, there are provided the first developer transport means for transporting, in a first direction, at least part of the developer to be circulated in a developer circulation path in a development unit; and the second developer transport means fur transporting the developer in a direction which is parallel with the first direction, and opposite to the first direction. Furthermore there is provided outside the development apparatus the foreign material removing means for removing from the developer foreign materials which do not contribute to the development of latent images, and at least one of the first developer transport means or the second developer transport means is connected with the foreign material removing means. Therefore, foreign materials can be removed without giving any adverse effects on the circulation of the developer in the development apparatus.

In the previously mentioned fourth development apparatus according to the present invention, the developer guide member including an opening at a lower portion thereof, with concave and convex portions being formed at least part of the inner peripheral surface thereof, and the magnetic field generating means for generating a magnetic field with the magnetic poles thereof being movable along the concave and convex portions of the developer guide member are used. Therefore, foreign materials can be effectively separated and eliminated from the developer by vibrating the developer with the concave and convex portions.

What is claimed is:

1. In a development apparatus comprising (a) a development unit provided with (i) a developer holding portion for holding therein a developer comprising a magnetic carrier and a toner, (ii) a developer bearing member for transporting said developer from said developer holding portion into a facing gap portion between the surface of a latent image bearing member and the surface of said developer bearing member, causing said developer to pass through said facing gap portion, and recovering said developer which has passed through said facing gap portion, and (iii) electric charge application means for applying electric charges to said toner contained in said developer which is to be carried by said developer bearing member to said facing gap portion, and (b) a toner holding unit for holding therein said toner to be supplied to said developer holding portion, said developer being transported onto said charge application means, thereby electrically charging said toner in said developer, and said developer being returned to said developer holding portion after said developer is transported to said latent image bearing member and a latent image formed on said latent image bearing member is developed with said toner to a visible toner image, the improvement wherein there are provided:

first developer transport means for transporting said developer to the outside of said development unit;

second developer transport means for transporting said developer into said development unit from the outside thereof;

third developer transport means for receiving said developer from said first developer transport means and transporting said developer to said second developer transport means by use of magnetic force; and foreign material recovering means for recovering foreign materials which cannot be transported by the magnetic force of said third developer transport means, a developer inlet for taking in said developer of said first developer transport means being situated, in a circulation path for said developer, at a position between said charge application means and said facing gap portion, or at a position between said facing gap portion and said developer holding portion.

2. The development apparatus of claim 1, further including mixing means for mixing developer during transport by each of said first developer transport means and said second development transport means.

3. A development apparatus for developing a latent image formed on a latent image bearing member with a magnetic developer, comprising:

first developer transport means for transporting said developer to the outside of a development unit;

second developer transport means for transporting said developer into said development unit from the outside thereof;

third developer transport means comprising a developer guide wall, developer suction means for sucking said developer by magnetic force through said developer guide wall, and means for moving said developer suction means, and capable of receiving said developer from said first developer transport means and transporting said developer to said second developer transport means; and foreign material recovering means for recovering foreign materials contained in said developer, which cannot be transported by said third developer transport means.

4. The development apparatus of claim 3, further including mixing means for mixing developer during transport by each of said first developer transport means and said second developer transport means.

5. A foreign material removing device for removing foreign materials from a developer comprising:

a developer guide member which is hollow, constitutes a substantially U-shaped developer transport path, disposed outside a development unit, and includes an opening in part of a lower guide wall thereof;

magnetic field generating means for generating a magnetic field with the poles thereof being successively rotatable along said developer transport path;

a receiving member disposed below said opening;

developer transport means for transporting said developer in said development unit to one end portion of said developer guide member; and developer transport means for transporting said developer from the other end portion of said developer guide member to said development unit.

6. The development apparatus of claim 5, further including mixing means for mixing developer during transport by each of said developer transport means.

7. A development apparatus for developing latent images formed on a latent image bearing member with a magnetic developer, comprising:

a developer guide member including an opening at a lower portion thereof, with concave and convex portions being formed at least part of the inner peripheral surface thereof;

magnetic field generating means for generating a magnetic field with the magnetic poles thereof being movable along said concave and convex portions of said developer guide member; and a receiving member disposed below said opening.

8. The development apparatus of claim 7, further including transport mixing means for transporting said developer to and from said developer guide member and for mixing said developer during transport.

9. A development apparatus for developing latent images formed on a latent image bearing member with a magnetic developer, comprising:

a transport arrangement for transporting developer to and from a separator;

said separator including a pipe through which said magnetic developer travels, said pipe having an opening at a lower end thereof, said separator further including movable magnetic force means located above said pipe for generating a moving magnetic force which transport said magnetic developer through said pipe while foreign material drops through said opening, whereby said pipe and said movable magnetic force means in combination transport said magnetic developer while separating foreign material from said magnetic developer and while said pipe maintains said magnetic developer separate from said movable magnetic means.

10. A development apparatus for developing latent images formed on a latent image bearing member with a magnetic developer, comprising:

a transport arrangement for transporting developer to and from a separator;

said separator including magnetic means for both transporting developer through said separator and for separating foreign material from said developer:

wherein said separator is located outside of a development unit of the development apparatus, and said transport arrangement transports developer from said development unit to said separator.

11. The development apparatus of claim 10, wherein said separator includes an opening into which foreign material enters as said magnetic means transports toner therepast.

* * * * *

UNITED STATES PATENT AND TRADEMARK OFFICE

CERTIFICATE OF CORRECTION

PATENT NO. : 5,335,051

DATED : August 2, 1994

INVENTOR(S) : Tatsuo Tani

It is certified that error appears in the above-indentified patent and that said Letters Patent is hereby corrected as shown below:

Column 2, line 12, after "developer" insert --is--.

Column 5, line 12, after "the" (second occurrence) insert --development unit to one end portion of the developer guide--;

line 26, change "an" to --a--;

line 30, change "an" to --a--; (1st. occurr.)

line 41, change ":" to --;--;

line 68, after "oped" insert --to--.

Column 8, line 29, change 1(*a*a) to --1(a)--;

line 53, change "51*a*" to --51*b*--.

Column 10, line 59, change "she" to --the--.

UNITED STATES PATENT AND TRADEMARK OFFICE

CERTIFICATE OF CORRECTION

PATENT NO. : 5,335,051

DATED : August 2, 1994

INVENTOR(S) : Tatsuo Tani

It is certified that error appears in the above-indentified patent and that said Letters Patent is hereby corrected as shown below:

Column 11, line 65, after "Furthermore" insert --,--.

Column 14, line 6, after "formed" insert --along--;
line 27, change "transport" to --transports--.

Signed and Sealed this

Fourteenth Day of November, 1995

*Attest:*

Bruce Lehman

BRUCE LEHMAN

*Attesting Officer*

*Commissioner of Patents and Trademarks*